United States Patent [19]

Killy

[11] 4,095,693

[45] Jun. 20, 1978

[54] RIBBED CARTON

[75] Inventor: Earl J. Killy, Monroe, La.

[73] Assignee: Olinkraft, Inc., West Monroe, La.

[21] Appl. No.: 794,300

[22] Filed: May 5, 1977

[51] Int. Cl.[2] ..... B65D 81/14

[52] U.S. Cl. ..... 206/433; 206/148; 206/591

[58] Field of Search ..... 206/141, 148, 149, 150, 206/427, 433, 434, 435, 549, 493, 482, 145–147, 160, 193, 586–591, 139; 217/26, 27; 229/42, 14 C

[56] References Cited

U.S. PATENT DOCUMENTS

| | | | |
|---|---|---|---|
| 827,124 | 7/1906 | Speer | 206/427 |
| 2,129,488 | 9/1938 | Bomberger | 206/433 |
| 2,314,198 | 3/1943 | Reamer | 206/433 |
| 3,351,264 | 11/1967 | Bostrom | 206/433 |
| 3,365,308 | 1/1968 | Janicke | 206/493 |
| 3,509,993 | 5/1970 | Michel | 206/433 |
| 3,804,234 | 4/1974 | Gordon | 206/433 |

FOREIGN PATENT DOCUMENTS

| | | | |
|---|---|---|---|
| 1,020,155 | 11/1952 | France | 206/433 |

*Primary Examiner*—William Price
*Assistant Examiner*—Bruce H. Bernstein
*Attorney, Agent, or Firm*—Norvell E. Von Behren

[57] ABSTRACT

An improved carton for packaging a plurality of multiple articles having a chime formed on one end thereof. The improved carton has a series of spacing means or ribs formed on at least one of the panels of the carton with the spacing means serving to abut a portion of the chimes of the multiple articles packaged within the carton. The spacing means serve to protect the exterior portion of the carton from becoming disfigured by the chimes of the multiple articles packaged within making circular indentations on the interior face and coming through to the exterior portion of the carton whenever several cartons are stacked on top of each other. The spacing means utilized serves to separate a major portion of the chimes from coming in contact with the underside of the panel thereby providing a much improved appearance of the advertising matter printed on the exterior of the package which is important to the sale of the package contents. The spacing means forming the ribbed carton may be formed in the preferred embodiment by a series of scorelines formed on the exterior face of at least one of the panels of the carton, and the scorelines may be formed in various patterns as desired by the customer and may also be formed in more than one panel of the carton, dependent upon the positioning of the cans in the carton and the types of cans that are to be packaged by the carton.

8 Claims, 10 Drawing Figures

RIBBED CARTON

BACKGROUND OF THE INVENTION

This invention relates generally to a multiple article package and more specifically relates to an improved multiple article package of the type wherein a plurality of similar articles are packaged within the carton.

In the present state of the high speed packaging of cans of beverages such as beer, soft drinks, or the like, it is desirous today to package these articles in multiples of usually 12 cans or 24 cans. The package containing the multiple articles also has advertising matter placed on one or more of the exterior panels of the package indicating the type of product contained within the package and other advertising suggestions.

After the multiple articles are packaged in the carton, they are then shipped to a retail outlet where they are placed for purchase by the customer. Since space is at a premium in most retail locations and also for the convenience in keeping a continual supply available, the retail outlet will stack the cartons on top of each other to varying heights, which can result in large weights being placed on similar cartons in the stack, especially at the bottom portion thereof. This heavy weight from stacking then results in the chimes of the beer or soft drink cans making an impression on the interior face of the carton which comes through to the exterior panel of the package causing a series of raised ring-like protrusions which are very unappealing to the purchaser and cause distortion of the exterior face of the package and in the printed advertising matter on the package.

SUMMARY OF THE INVENTION

In order to overcome the problems inherent in the prior art type of packages, there has been provided by the subject invention a new and novel improved carton which is designed to eliminate underside package chime indentations which cause ring-like raised protrusions on the exterior panel or panels of the package. This is accomplished by utilizing a series of spacing means or ribs formed at predetermined positions on at least one of the panels of the cartons with the ribs in the preferred embodiment being formed by a series of spaced scorelines which are placed from the exterior of the panel to abut a minor portion of the chimes of the cans packaged within the carton. The scoreline spacing means then serve to prevent a major portion of the chime from coming in contact with the underside of an exterior panel of the carton, thereby allowing a major portion of an exterior panel to be undistorted and therefore more appealing to the eye of the ultimate customer.

Accordingly, it is an object of the invention to provide a new and novel multiple package having means formed on the package for removing the distortion causing indentations of the chimes of the articles contained in the carton on the underside of the panels of the carton.

Another object of the invention is to provide a new and improved multiple package wherein a series of spacing means in the form of scorelines are formed at predetermined positions on at least one of the panels of the carton from the carton exterior and extend longitudinally along the length of at least one of the panels of the carton.

Still yet another object of the invention is to provide an improved multiple package carton having a series of spacing means which may be formed in various patterns on at least one of the panels of the carton from the exterior of the panel with the spacing means serving to abut a minor portion of the chimes of the cans contained in the article carrier in order to prevent a major portion of the chimes from disfiguring the inside and outside of the package.

Still yet another object of the invention is to provide a new and improved multiple article package wherein the top face of the package is relatively distortion free and does not receive chimed can impressions on the face of the package whenever similar packages are stacked one on top of the other.

These and other advantages of the invention will become apparent from a review of the drawing attached herewith and from a reading of the description of the preferred embodiment.

DESCRIPTION OF THE PREFERRED EMBODIMENT

Figure 3:
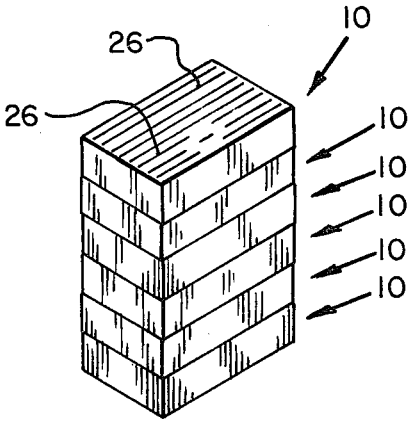
FIG. 3 is a perspective view showing a series of cartons of the type shown in FIG. 1 stacked one on top of the other as they would be positioned in a retail outlet.
Figure 2:
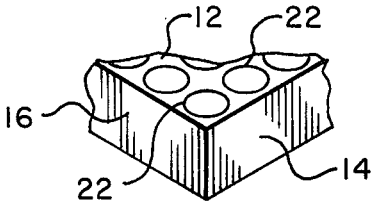
FIG. 2 is a perspective cut-away portion of a corner of a prior art type of package showing a series of raised ring-like impressions formed on one of the panels of the carton from the chimes of the cans within the carton.
Figure 1:
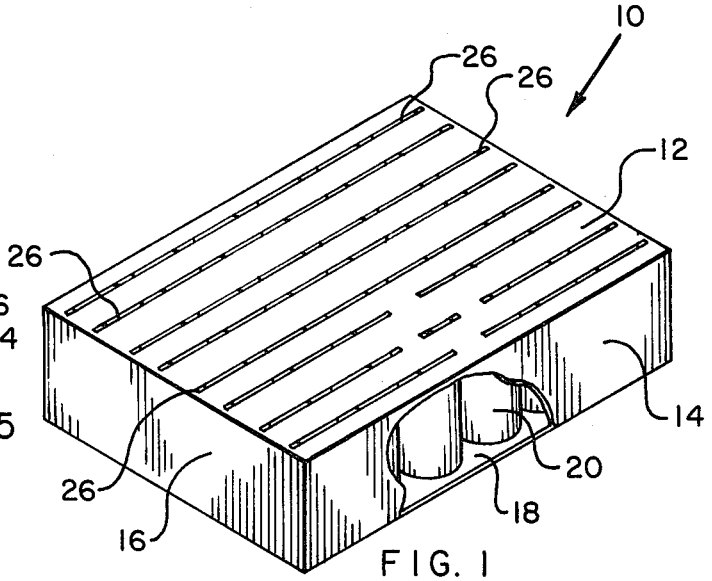
FIG. 1 is a perspective view of a multiple article package of the subject invention showing a portion of the package cut away to illustrate a plurality of chimed articles such as beer or soft drink cans contained within the package.

Referring now generally to the drawing figures and in particular to FIGS. 1–3 of the drawings there is shown in FIG. 1 the new and improved multiple package carton of the subject invention generally by the numeral 10 of the type being formed from a plurality of hingedly connecting panels 12, 14, 16, 18 as well as other panels not shown. For example, the panel 14 would be a side panel and there would be a similar size side panel opposite to 14 but not shown in the drawing and in a like manner the panel 16 would be an end panel and there would be a similar sized end panel on the opposite side of the package not shown in the drawing.

Figure 5:
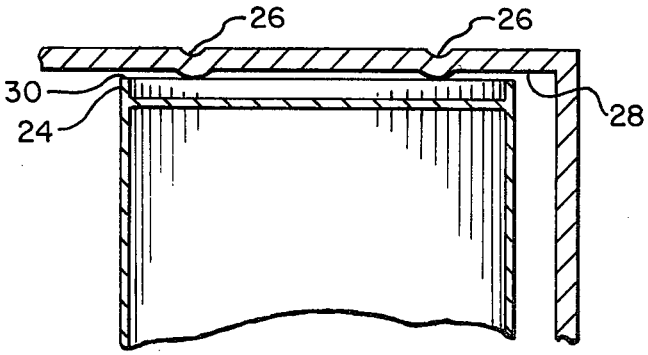
FIG. 5 is a partial side sectional view taken along Line 5—5 of FIG. 4 showing the spacing means and how it reacts with the chimes of the cans packaged in the carton.

The multiple article package of the subject invention is designed to contain a plurality of cans 20 positioned within the article carrier and as before mentioned, similar packages 10 are generally stacked one on top of the other as shown in FIG. 3 of the drawing at the retail outlet store. Whenever this occurs, as before mentioned, indentations 22 are formed on the exterior panel 12 of the package as shown in FIG. 2 of the drawing. These indentations 22 are caused by the chime 24 of the can pushing through the exterior panel 12 whenever the packages are stacked one on top of the other in the manner shown in FIG. 3. The chime of a typical can is shown in FIG. 5 of the drawing and the protrusions 22 have been found to be undesirable by the purchaser of the carton since they cause raised ring-like distortions or protrusions 22 on the exterior of panel 12 which is generally printed in multi-color with various advertising materials.

Referring now particularly to FIGS. 1, 3, 4 and 5 of the drawing there is shown in detail the new and improved spacing means which is formed on at least one of the panels of the carton to eliminate the beforementioned protrusions 22 on the exterior panel. The spacing means may be formed as a series of ribs or elongated scorelines 26 which are placed on a desired panel of the carton from the outer side in such a manner as to cause an indentation on the inside of the carton which will abut a minor portion of the chimes 24 of the cans 20 to thereby separate a major portion of the circular chime from the bottom surface 28 of the panel. When formed in this manner a major portion of the top portion 30 of a majority of the chimes in the package are unable to come in contact with the bottom surface 28 of the exterior panel thereby eliminating the undesirable appearing protrusions 22 over a major portion of the exterior face of the package.

Figure 4:
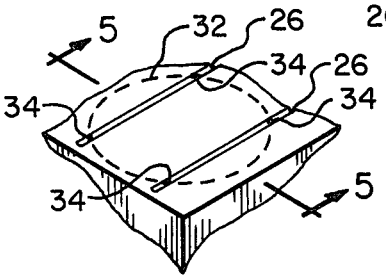
FIG. 4 is an enlarged cut-away portion of the subject invention, similar in position to the FIG. 2 view of the drawing, showing the new and improved spacing means formed on one of the panels of the carton to eliminate the raised ring-like impressions.

By referring to FIG. 4 of the drawing it can be seen how the scorelines 26 function in this manner and how they serve to eliminate the circular protrusions 22 across the major portion of the chime which is shown in FIG. 4 by the dash line 32. The only portion of the chime 24 of the can 20 which is indented on the inside face of the package and hence on the exterior panel of the package is the very small portions 34 where the top portion of the chime 30 abuts the bottom surface 28 of the scoreline 26. While the use of the scorelines 26 as spacing means does not totally eliminate the protrusions 22 on the exterior panel of the carton, they do cause a major reduction in the protrusions 22 which allows the face of the package to be relatively distortion free and makes the face of the package more appealing to the customer.

Figure 6:
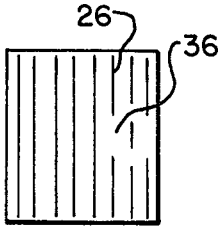
FIGS. 6 through 10 are top views of packages of the subject invention showing modifications of the preferred embodiment wherein the spacing means are formed in various directions and patterns as desired by the customer.
Figure 7:
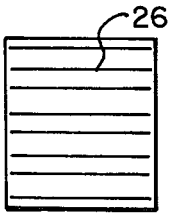
Figure 8:
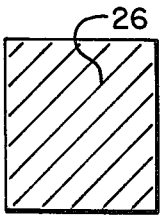
Figure 9:
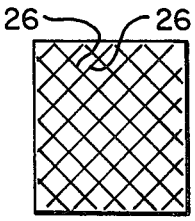

Referring now to FIGS. 6 through 10 of the drawing there are shown variations of the preferred embodiment wherein the scorelines 26 may be formed longitudinally along the length of at least one of the panels of the carton as shown in FIG. 6 of the drawing. If it is desired by the purchaser of the carton, the scorelines 26 may also be formed transversely along the width of at least one of the panels of the carton as shown in FIG. 7 of the drawing. It may also be desirable to form the scorelines 26 diagonally on at least one of the panels of the carton as is shown in FIG. 8 of the drawing and as a variation of FIG. 8, the purchaser of the carton may desire to have the scorelines formed diagonally in two directions on at least one of the panels of the carton as shown in FIG. 9 of the drawings.

Figure 10:
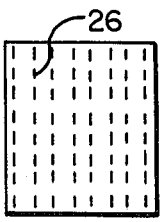

It may also be desirable to form the scorelines 26 intermittently along at least one of the panels of the carton as shown in FIG. 10 of the drawing and it is within the spirit and scope of the invention that if the purchaser of the carton desires the intermittent formation such as shown in FIG. 10 of the drawing that this could also be applied to transverse scorelines as shown in FIG. 7 or diagonal scorelines as shown in FIG. 8 and cross latched diagonal scorelines as shown in FIG. 9.

It is also within the spirit and scope of the invention that other patterns may be utilized in the formation of the scorelines to achieve the same ultimate result of separation of the chime of the can from the underside of the exterior panel of the package. Whenever the package is designed to contain cans of the type having chimes not only on the top of the can but on the bottom of the can then it is within the spirit and scope of the invention to form the spacing means on the top panel 12 as well as the bottom panel 18 of the package. It may also be desirable to form the spacing means on the side panels 14 and their opposite side panels not shown in the drawing as well as on the end panels 16 and their opposite end panels not shown in the drawings in the event that the cans are positioned in the package so that their chime or chimes are bearing against either the side panels or the end panels.

While in the preferred embodiment shown the spacing means have been formed by a series of scorelines 26, it is within the spirit and scope of the invention that the spacing means could be formed by other means such as the utilization of separate strips which may be adhesively joined to the bottom surface 28 of the package so as to abut the top portion 30 of the chime of the can thereby achieving the same result of elmination of a major portion of the protrusions 22. When the improved package is formed as described in the preferred embodiment with the plurality of scorelines 26 serving as spacing means, it is desirable in some cases to omit a small portion of the scorelines 26 in a portion of the face of the exterior panel where the scorelines are applied so that the package can be formed by a packaging machine without the scorelines interfering with the withdrawal of the production blank from its associated hopper. By referring to FIG. 6 of the drawing it can be seen where a portion 36 of the scorelines 26 are omitted and it is within this omitted portion 36 that the suction cup from the packaging machine is applied to withdraw the production blank of the package from the packaging machine hopper. It has been found that the omitted portion 36 serves to allow the suction cup to function better without losing its vacuum as a result of air seeping through the indentations caused by the scorelines 26 in the top of the package. The omitted portion 36 may be formed on any of the variations of the package as shown in FIGS. 5 - 10 and would be eliminated on those packaging machines where a suction cup feed would not be utilized.

From the above it can be seen that there has been provided by the subject invention a new and improved multiple article package for packaging a plurality of beer or soft drink cans with the new and improved package eliminating the undesirable indentations formed by the can chimes on the undersurface of the exterior panel of the package which causes undesirable protrusions on the exterior face of the package. While the preferred embodiment has been shown by way of illustration, it is within the spirit and scope of the invention that many changes can be made in the various parts of the invention in order to obtain the before described spacing means and the invention is not to be limited to the spacing means shown and described.

Having described my invention, I claim:

1. A carton of the type comprising:

(a) an interior portion for packaging multiple articles having a chime formed on at least one end thereof;

(b) an exterior face where printed advertising matter is placed thereon;

(c) the carton being formed from a single layer material and having a plurality of hingedly connected panels and a plurality of closing flaps;

(d) at least one of the panels of the single layer material having a series of scorelines formed on the exterior face;

(1) said scorelines causing a protuberance into the interior of the carton to lightly abut and to initially prevent a major portion of the chimes of the multiple articles packaged therein from coming in contact with the underside of said one of the panels whenever a plurality of chimed articles are initially positioned within the carton;

(2) said scorelines further serving to finally protect the exterior face of the carton from becoming disfigured by the chimes of the multiple articles making circular indentations on the interior face of the carton;

(a) said protection being obtained by the protuberance of the scorelines permitting only a predetermined portion of the scoreline protuberance to be indented by the chimes of the multiple articles whenever a plurality of cartons are stacked on top thereof; and (3) said protection resulting in a major reduction in indentations of the chimes coming through to the exterior face of the carton to form ring-like protrusions upon multiple stacking of the cartons and thereby allowing the exterior portion of the carton to be relatively distortion free and more appealing to the customer.

2. The single layer carton as defined in claim 1 wherein said scorelines extend longitudinally along the length of at least one of the panels of the carton.

3. The single layer carton as defined in claim 1 wherein said scorelines extend transversely along the width of at least one of the panels of the carton.

4. The single layer carton as defined in claim 1 wherein said scorelines extend diagonally on at least one of the panels of the carton.

5. The single layer carton as defined in claim 1 wherein said scorelines extend diagonally in two directions on at least one of the panels of the carton.

6. The single layer carton as defined in claim 1 wherein said scorelines extend intermittently along at least one of the panels of the carton.

7. The single layer carton as defined in claim 1 wherein a portion of said scorelines is omitted in predetermined area to thereby aid in removal of the production blank of the carton by a suction cup.

8. The single layer carton as defined in Claim 1 whereby the scorelines abut a minor portion of each of the multiple articles packaged therein at four locations thus separating a major portion of the chimes from coming in contact with the underside of at least one of the panels of the carton.

* * * * *

UNITED STATES PATENT OFFICE

CERTIFICATE OF CORRECTION

Patent No. 4,095,693 Dated June 20, 1978

Inventor(s) Earl J. Killy

It is certified that error appears in the above-identified patent and that said Letters Patent are hereby corrected as shown below:

Column 3, Line 67, delete "latched" and insert in place thereof -- hatched --.

Column 6, Line 20, delete "area" and insert in place thereof -- areas --.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*